US005924472A

United States Patent [19]

Suzuki et al.

[11] Patent Number: 5,924,472

[45] Date of Patent: Jul. 20, 1999

[54] METHOD OF PRODUCING A PISTON THROUGH CASTING

[75] Inventors: Takao Suzuki, Numazu; Asami Tsuchiya, Susono, both of Japan

[73] Assignee: Toyota Jidosha Kabushiki Kaisha, Aichi-Ken, Japan

[21] Appl. No.: 08/845,531

[22] Filed: Apr. 25, 1997

[30] Foreign Application Priority Data

Jun. 4, 1996 [JP] Japan ..... 8-142019

[51] Int. Cl.[6] ..... B22D 15/02

[52] U.S. Cl. ..... 164/137; 164/340; 164/342

[58] Field of Search ..... 164/137, 339, 164/340, 342

[56] References Cited

U.S. PATENT DOCUMENTS 1,792,580 2/1931 Fehrenbach .
3,897,817 8/1975 Nieman .
5,289,866 3/1994 Parsley et al. ..... 164/342 X

FOREIGN PATENT DOCUMENTS 2638988 5/1990 France .
2-220733 9/1990 Japan .
5-86971 4/1993 Japan .
2163374 2/1986 United Kingdom .
2250938 6/1992 United Kingdom .

*Primary Examiner*—J. Reed Batten, Jr.
*Attorney, Agent, or Firm*—Kenyon & Kenyon

[57] ABSTRACT

In a method of producing a piston through casting, the piston has a piston head, a skirt, a pin boss and a supporting area, the supporting area connecting a periphery of the pin boss with the skirt. A plurality of molds are arranged such that the molds form cavities corresponding to a configuration of the piston. Mold matching surfaces between the molds are arranged such that the molds are contacted by each other at positions different from corners of the supporting area of the piston. A casting is performed by using the molds so that the piston is produced.

10 Claims, 4 Drawing Sheets

METHOD OF PRODUCING A PISTON THROUGH CASTING

BACKGROUND OF THE INVENTION (1) Field of the Invention

The present invention generally relates to a piston of an engine, and more particularly to a method of producing a piston of an internal combustion engine through casting.

(2) Description of the Related Art

A piston of an internal combustion engine generally has a piston head, a skirt, a pin boss, and a supporting area, the supporting area connecting a periphery of the pin boss with the skirt. The piston is usually produced from a light alloy, such as an aluminum alloy, through casting.

The piston has a complicated configuration, as mentioned above, and it is necessary that a plurality of molds be used by the casting for the production of the piston, and that the molds be arranged to form cavities corresponding to the complicated configuration of the piston. The molds must be arranged so as to form the configuration of the piston and facilitate the removal of the molds after the casting is finished.

For example, Japanese Laid-Open Patent Application No. 5-86971 discloses a method of producing a piston through casting. In this piston production method, a plurality of molds are arranged to form cavities corresponding to the configuration of the piston, and molten metal is poured into the cavities of the molds so that the casting for the production of the piston is performed. Japanese Laid-Open Patent Application No. 2-220733 discloses a method of producing a piston through casting. In this piston production method, a plurality of molds are arranged to form cavities corresponding to the configuration of the piston, and the casting for the production of the piston is performed. The molds of the above-mentioned publication include a fusible core mold supported by a strut, and the fusible core mold is arranged to form an internal cavity inside a top ring groove of the piston.

On the other hand, when the engine is assembled, a piston pin is fitted into the pin boss of the piston, and the piston is connected to a connecting rod by the piston pin. The connecting rod connects a crankshaft of the engine to the piston.

When the crankshaft of the engine is rotated, the piston moves up and down in a cylinder of the engine. At the time of the combustion stroke of the engine, the piston transmits the power, obtained by the combustion of fuel in the combustion chamber, to the crankshaft through the connecting rod and the piston pin. During the operation of the engine, compression and expansion forces from the connecting rod are exerted on the pin boss of the piston by the piston pin. These forces are transmitted from the pin boss to the supporting area, and a great stress on the supporting area of the piston is produced. Since the piston pin is supported on the pin boss of the piston, the corners of the supporting area around the periphery of the pin boss are subjected to the stress concentration.

In addition, the skirt of the piston is subjected to a frictional stress due to the reciprocating motion of the piston relative to the cylinder of the engine, and a great stress at a central portion of the skirt of the piston is produced.

As described above, when the piston is produced through the casting, the plurality of molds are arranged to form cavities corresponding to the configuration of the piston. When the casting for the production of the piston is performed, molten metal may flow out of a clearance between two of the molds which are contacted by each other, and a flash on a mold matching surface between the two molds may be produced as the result of the casting. The flash has sharp edges, and the stress concentration on the flash of the casting is very likely to take place.

For this reason, if the flash at any of the positions of the piston where a great stress is produced, such as the corners of the supporting area or the central portion of the skirt, is produced as a result of the casting, such positions of the piston may be easily cracked or damaged. In the conventional piston production method of the above publication, effective measures for preventing the occurrence of the flash at such positions of the piston as the result of the casting are not taken into account.

SUMMARY OF THE INVENTION

An object of the present invention is to provide an improved piston production method in which the above-described problems are eliminated.

Another object of the present invention is to provide a piston production method which effectively prevents the occurrence of the flash at the positions of the piston where a great stress is very likely to be produced.

The above-mentioned objects of the present invention are achieved by a method of producing a piston through casting, wherein the piston has a piston head, a skirt, a pin boss and a supporting area, the supporting area connecting a periphery of the pin boss with the skirt, the method comprising the steps of: arranging a plurality of molds such that the molds form cavities corresponding to a configuration of the piston; arranging mold matching surfaces between the molds such that the molds are contacted by each other at positions different from corners of the supporting area of the piston; and performing a casting by using the molds so that the piston is produced.

The above-mentioned objects of the present invention are achieved by a method of producing a piston through casting, wherein the piston has a piston head, a pair of skirt areas, a pair of pin bosses and a pair of supporting areas, the supporting areas connecting peripheries of the pin bosses with the skirt areas, the method comprising the steps of: arranging a main mold, a pair of external molds, a pair of side core molds and a central core mold such that the main mold, the external molds, the side core molds and the central core mold form cavities corresponding to a configuration of the piston; arranging mold matching surfaces between the external molds and the side core molds such that the external molds and the side core molds are contacted at positions different from corners of the supporting areas of the piston; arranging mold matching surfaces between the side core molds and the central core mold such that the side core molds are contacted by the central core mold, and external ends of the mold matching surfaces between the side core molds and the central core mold are located at positions different from central portions of the skirt areas; and performing the casting by using the main mold, the external molds, the side core molds and the central mold so that the piston is produced.

In the piston production method of the present invention, it is possible to effectively prevent the occurrence of the flash at any of the corners of the piston when the casting is performed. It is possible to safely prevent the supporting area having the corners of the piston from being cracked or damaged due to excessively great stress. Further, in the piston production method of the present invention, it is possible to effectively prevent the occurrence of the flash at the central portions of the skirt areas of the piston when the casting is performed. It is possible to safely prevent the skirt areas of the piston from being cracked or damaged due to excessively great stress.

BRIEF DESCRIPTION OF THE DRAWINGS

The above and other objects, features and advantages of the present invention will become more apparent from the following detailed description when read in conjunction with the accompanying drawings in which.

DESCRIPTION OF THE PREFERRED EMBODIMENTS

A description will now be given of the preferred embodiments of the present invention with reference to the accompanying drawings.

Figure 1:
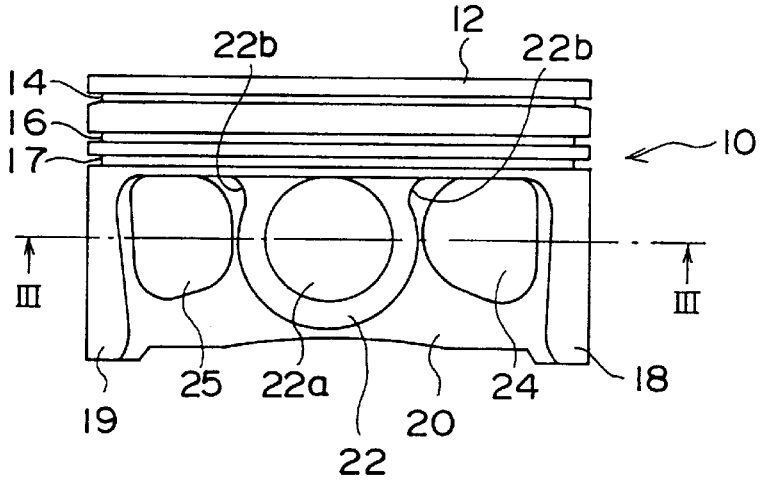
FIG. 1 is a side view of a piston which is produced by carrying out a piston production method of the present invention.

FIG. 1 shows a piston 10 which is produced by carrying out a piston production method of the present invention. In FIG. 1, a combustion chamber (not shown) of the engine is formed on the upper side of the piston 10, and a crankshaft (not shown) of the engine is placed on the lower side of the piston 10.

Figure 2:
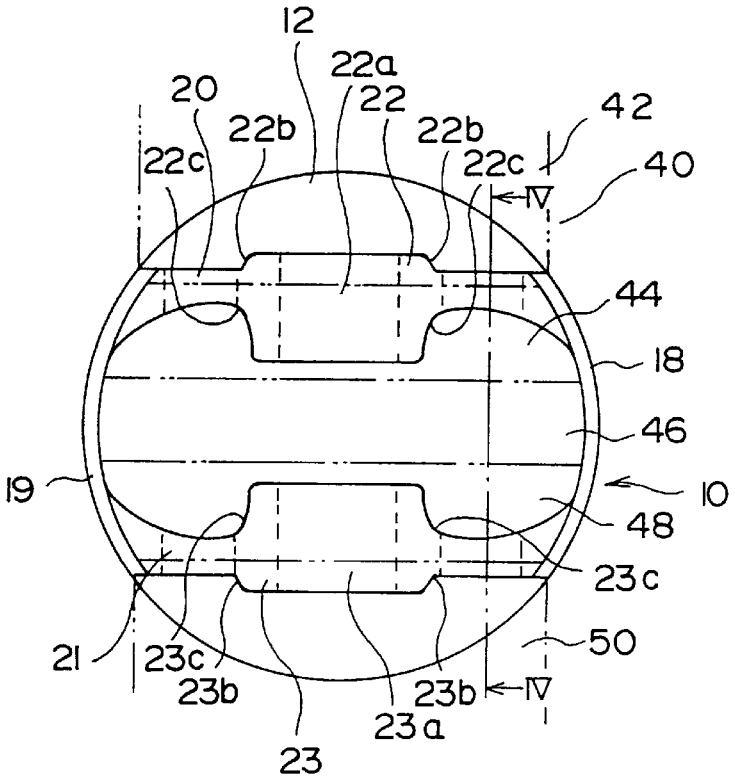
FIG. 2 is a bottom view of the piston of FIG. 1 with indications of mold matching surfaces used by a first embodiment of the piston production method.
Figure 3:
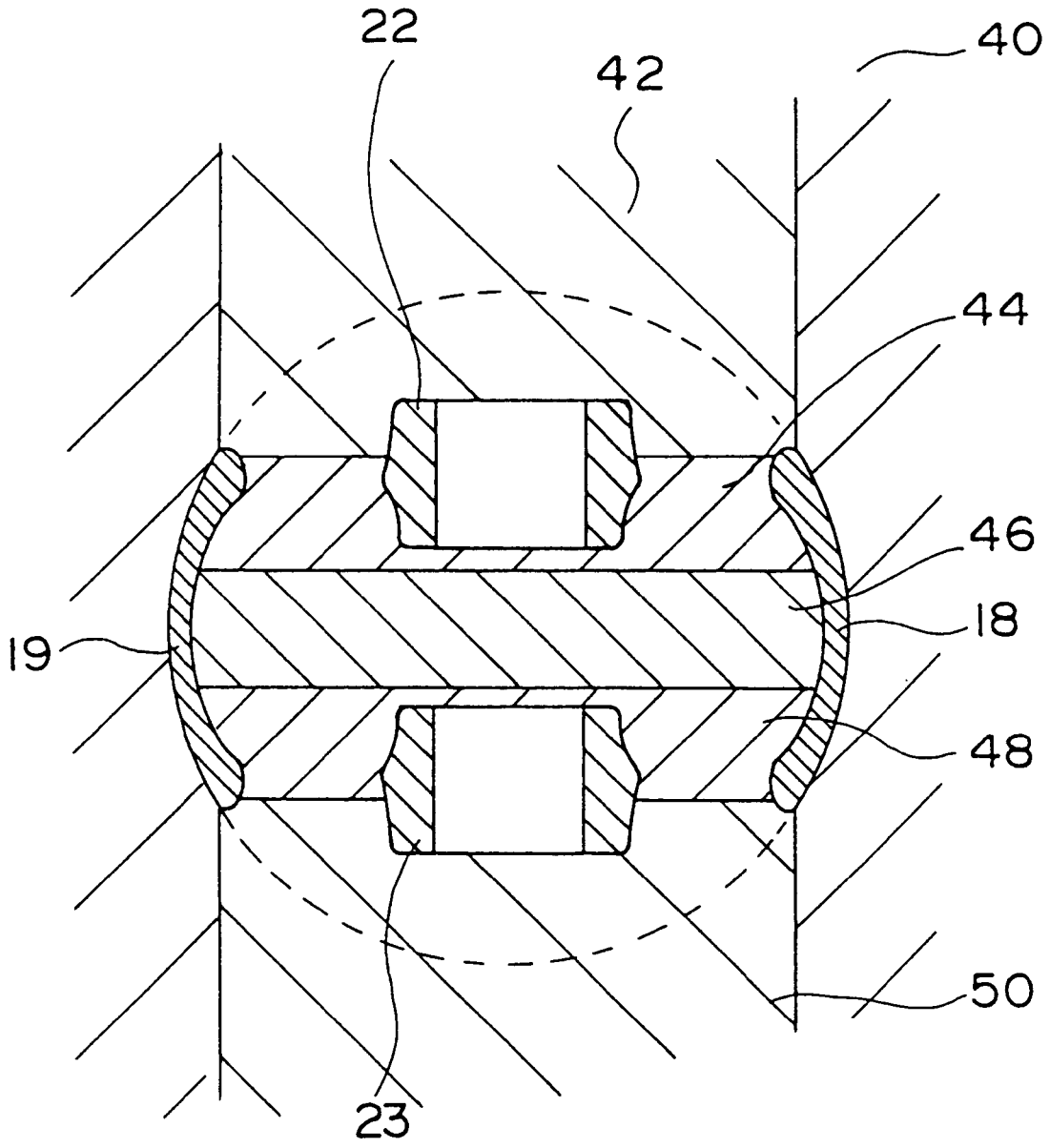
FIG. 3 is a cross-sectional view of the piston taken along a line III—III indicated in FIG. 1, with indications of molds used by the first embodiment of the piston production method.
Figure 4:
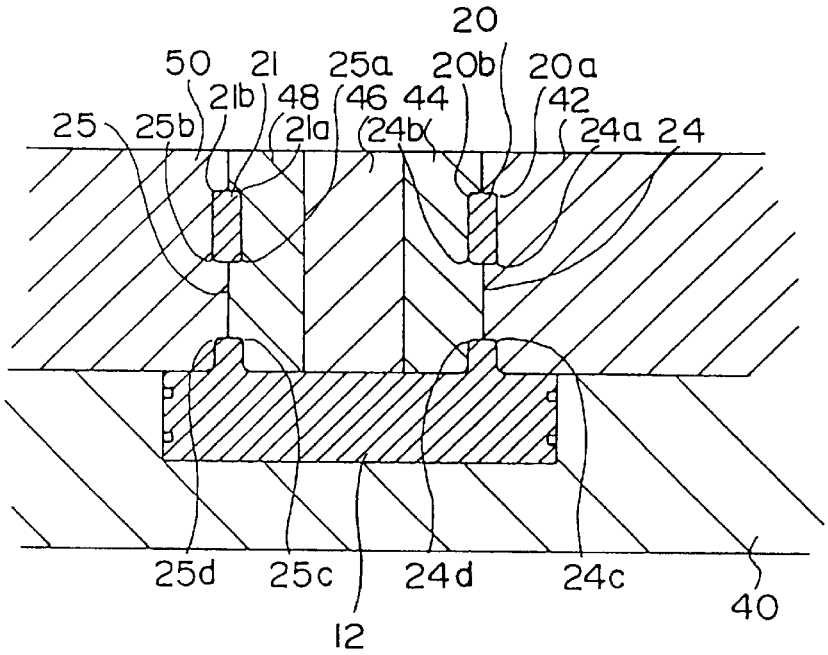
FIG. 4 is a cross-sectional view of the piston taken along a line IV—IV indicated in FIG. 2, with indications of the molds used by the piston production method.

FIG. 2 is a bottom view of the piston 10 of FIG. 1 with indications of mold matching surfaces used by a first embodiment of the piston production method. FIG. 3 is a cross-sectional view of the piston 10 taken along a line III—III indicated in FIG. 1, with indications of molds 40 through 50 used by the first embodiment of the piston production method. FIG. 4 is a cross-sectional view of the piston 10 taken along a line IV—IV indicated in FIG. 2, with indications of the molds 40 through 50 used by the first embodiment of the piston production method.

The piston 10 is integrally formed through casting of a light alloy such as an aluminum alloy.

As shown in FIGS. 1 through 3, the piston 10 comprises a piston head 12 which forms the bottom of a combustion chamber of the engine. A plurality of ring grooves 14, 16 and 17 on the outer peripheral surface of the piston head 12 are formed. A plurality of piston rings (not shown) are fitted into the ring grooves 14, 16 and 17, and the piston 10 can move up and down in the cylinder of the engine while the combustion chamber is pneumatically sealed by the piston rings.

On the crankshaft side of the piston head 12, a pair of skirt areas 18 and 19 and a pair of pin bosses 22 and 23 are formed. The skirt area 18 and the skirt area 19 are provided symmetrically with respect to a central longitudinal axis of the piston 10. The skirt areas 18 and 19 downwardly extend along the outer peripheral surface of the piston head 12. The pin boss 22 and the pin boss 23 are located in the middle of the skirt areas 18 and 19, and they are provided symmetrically with respect to the central longitudinal axis of the piston 10.

Further, on the crankshaft side of the piston head 12, a pair of supporting areas 20 and 21 are formed. As shown in FIG. 2, the supporting area 20 horizontally extends from ends of the skirt areas 18 and 19, and the supporting area 21 horizontally extend from the other ends of the skirt areas 18 and 19. The supporting area 20 connects the pin boss 22 with the ends of the skirt areas 18 and 19, and the supporting area 21 connects the pin boss 23 with the other ends of the skirt areas 18 and 19. The pin bosses 22 and 23 are located in the middle of the supporting areas 20 and 21, respectively, and the thickness of each of the pin bosses 22 and 23 is increased and greater than the thickness of each of the supporting areas 20 and 21.

As shown in FIGS. 1 and 2, the pin boss 22 has a piston pin bore 22*a* in the center of the pin boss 22, and the pin boss 23 has a piston pin bore 23*a* in the center of the pin boss 23. At the time of assembly of the engine, a piston pin (not shown) is fitted into the piston pin bores 22*a* and 23*a* of the piston 10, and the piston 10 is connected to a connecting rod (not shown) via the piston pin. For this reason, a great force from the connecting rod through the piston pin is exerted on the pin bosses 22 and 23 of the piston 10. The pin bosses 22 and 23 have the increased thickness greater than the thickness of the supporting areas 20 and 21, and the pin bosses 22 and 23 must have a strength that is great enough to withstand the force exerted by the piston pin.

Further, rounded portions 22*b* and 23*b* between the outer surfaces of the pin bosses 22 and 23 and the bottom of the piston head 12 are formed. Rounded portions 22*c* and 23*c* between the inner surfaces of the pin bosses 22 and 23 and the bottom of the piston head 12 are formed. The rounded portions 22*b*, 23*b*, 22*c* and 23*c* include rounded surfaces in all the boundary areas between the piston head 12 and the pin bosses 22 and 23 and the boundary areas between the supporting areas 20 and 21 and the pin bosses 22 and 23. The rounded portions 22*b*, 23*b*, 22*c* and 23*c* serve to reduce the stress concentration at the boundary areas between the piston head 12 and the pin bosses 22 and 23 and the stress concentration at the boundary areas between the supporting areas 20 and 21 and the pin bosses 22 and 23 when the force is exerted by the piston pin on the pin bosses 22 and 23 as mentioned above.

Further, a set of openings 24 and 25 at intermediate portions of the supporting areas 20 and 21 on the sides of each of the pin bosses 22 and 23 are formed. The forming of the openings 24 and 25 of the piston 10 serves to reduce the weight of the piston 10.

As shown in FIGS. 2 through 4, when the casting for producing the piston 10 is carried out, a main mold 40 and a plurality of molds 42, 44, 46, 48 and 50 are used. As shown, the casting is performed to produce the piston 10 in its inverted condition in which the piston 10 is inverted upside down (or the piston head 12 is on the bottom of the piston 10).

In the present embodiment, the molds 42 and 50 are external molds which are arranged outside the piston 10, the molds 44 and 48 are side core molds which are arranged inside the piston 10, and the mold 46 is a central core mold which is arranged inside the piston 10 and in the center of the cavities of the piston 10.

The outer surfaces of the pin bosses 22 and 23 and the supporting areas 20 and 21 of the piston 10 are shaped by the molds 42 and 50 which are arranged outside the piston 10. The inner surfaces of the pin bosses 22 and 23 and the supporting areas 20 and 21 are shaped by the core molds 44, 46 and 48 which are arranged inside the piston 10 and contacted by each other. More specifically, the inner surfaces of the pin boss 22 and the supporting area 20 are shaped by the side surface of the core mold 44, and the inner surfaces of the pin boss 23 and the supporting area 21 are shaped by the side surface of the core mold 48.

Further, the inner surfaces of the skirt areas 18 and 19 are shaped by the end surfaces of the core molds 44, 46 and 48. More specifically, the inner surface of the skirt area 18 is shaped by the right end surfaces of the core molds 44, 46 and 48, and the inner surface of the skirt area 19 is shaped by the left end surfaces of the core molds 44, 46 and 48.

Further, as shown in FIG. 4, the bottom surface of the piston head 12 (in the inverted condition) is shaped by the lower surface of the main mold 40. The outer peripheral surfaces of the skirt area 18 and 19 and the piston head 12 are shaped by the inner side surfaces of the main mold 40.

Apart from the above-mentioned elements, the piston pin bores 22*a* and 23*a* and the ring grooves 14, 16 and 17 are formed by subsequent machining after the casting is carried out.

In the above-described embodiment, as shown in FIG. 4, a mold matching surface between the molds 42 and 44 and a mold matching surface between the molds 48 and 50 are arranged such that the mold matching surfaces do not accord with corners of the supporting areas 20 and 21. That is, the mold 42 and the mold 44 are contacted by each other at positions different from the corners of the supporting area 20, and the mold 48 and the mold 50 are contacted by each other at positions different from the corners of the supporting area 21.

Therefore, as shown in FIG. 4, corners 20*a* and 20*b* of the supporting area 20, corners 21*a* and 21*b* of the supporting area 21, corners 24*a* through 24*d* of the inner peripheral wall of the opening 24, and corners 25*a* through 25*d* of the inner peripheral wall of the opening 25 are not located on the mold matching surfaces between the molds, and these corners are shaped by one of the molds 42, 44, 48 and 50. Each of the corners 20*a* and 20*b*, the corners 21*a* and 21*b*, the corners 24*a*–24*d* and the corners 25*a*–25*d* is formed by a rounded portion of a corresponding one of the molds 42, 44, 48 and 50 when the casting is performed.

The casting for the production of the piston 10 in the above-described embodiment is carried out as follows. The molds 42 through 50 are arranged on the main mold 40, as shown in FIGS. 2 through 4, such that the molds 40 through 50 form the cavities corresponding to the shape of the piston 10. Molten metal of the aluminum alloy is poured into the cavities of the molds 40 through 50. An appropriate level of pressure is applied to the molten metal in the molds 40 through 50 by using a known technique. After the molten metal becomes solid by cooling, the mold 46 is first removed by pulling it upward. Then the molds 44 and 48 are moved to the center of the molds 44 and 48, and each of the molds 44 and 48 is removed by pulling it upward one by one so as not to interfere with the pin bosses 22 and 23 of the piston 10. The molds 42 and 50 are removed by moving them sideways in opposite directions. After the molds 42 through 50 are removed, the piston 10 obtained as a result of the casting is finally taken out.

As described above, the piston pin (not shown) is fitted into the piston pin bores 22*a* and 23*a* of the piston 10, and the piston 10 is connected to the connecting rod (not shown) by the piston pin. The connecting rod connects the crankshaft (not shown) of the engine to the piston. When the crankshaft is rotated, the piston 10 moves up and down in the cylinder of the engine. At the time of the combustion stroke of the engine, the piston 10 transmits the power, obtained by the combustion of fuel in the combustion chamber, to the crankshaft through the connecting rod and the piston pin. During the operation of the engine, compression and expansion forces from the connecting rod are exerted on the pin bosses 22 and 23 of the piston 10 by the piston pin. These forces are transmitted from the pin bosses 22 and 23 to the supporting areas 20 and 21, and a great stress on the supporting areas 20 and 21 is produced by these forces.

Further, the piston head 12 forms the bottom of the combustion chamber of the engine, and heat energy from the combustion chamber is transmitted to the supporting areas 20 and 21 via the piston head 12. Therefore, the supporting areas 20 and 21 are subjected to a high temperature due to the heat energy from the combustion chamber. For this reason, it is more likely that the stress concentration on the supporting areas 20 and 21 takes place due to thermal stress on the supporting areas 20 and 21 produced by the heat energy from the combustion chamber. Especially, the corners 20*a* and 20*b* of the supporting area 20, the corners 21*a* and 21*b* of the supporting area 21, the corners 24*a* through 24*d* of the inner peripheral wall of the opening 24, and the corners 25*a* through 25*d* of the inner peripheral wall of the opening 25 are subjected to a great stress due to the stress concentration.

Generally, when the casting for the production of the piston 10 is performed, molten metal may flow out of a clearance between two molds which are contacted by each other, and a flash on a mold matching surface between the two molds may be produced as the result of the casting. The flash has sharp edges, and the stress concentration on the flash of the casting is very likely to take place.

Therefore, if the corners 20*a* and 20*b* of the supporting area 20, the corners 21*a* and 21*b* of the supporting area 21, the corners 24*a* through 24*d* of the inner peripheral wall of the opening 24, and the corners 25*a* through 25*d* of the inner peripheral wall of the opening 25 are located on the mold matching surfaces, the flash at these corners of the piston 10 is likely to be produced as the result of the casting. If the flash at these corners of the piston 10 is produced, the supporting areas 20 and 21 or the inner peripheral walls of the openings 24 and 25 of the piston 10 may be cracked or damaged due to excessively great stress on the flash of the casting.

In the above-described embodiment, the corners 20*a* and 20*b* of the supporting area 20, the corners 21*a* and 21*b* of the supporting area 21, the corners 24*a* through 24*d* of the inner peripheral wall of the opening 24, and the corners 25*a* through 25*d* of the inner peripheral wall of the opening 25 are not located on the mold matching surfaces between the molds, and these corners are shaped by one of the molds 42, 44, 48 and 50. Each of the corners 20*a* and 20*b*, the corners 21*a* and 21*b*, the corners 24*a*–24*d* and the corners 25*a*–25*d* is formed by a rounded portion of a corresponding one of the molds 42, 44, 48 and 50 when the casting is performed. Therefore, in the above-described embodiment, it is possible to effectively prevent the occurrence of the flash at the corners of the supporting areas 20 and 21 and at the corners of the inner peripheral surfaces of the openings 24 and 25 when the casting is performed. It is possible to safely prevent the supporting areas 20 and 21 and the inner peripheral walls of the openings 24 and 25 of the piston 10 from being cracked or damaged due to excessively great stress.

In the above-described embodiment, the mold matching surfaces between the molds are located on flat surfaces different from the corners of the piston 10. The flash on any of the flat surfaces may be produced as the result of the casting. However, the stress on the flash on the flat surfaces of the piston 10, if any, is small and insignificant in comparison with the stress on the flash at the corners of the piston 10. Therefore, if the flash on any of the flat surfaces is produced, the stress concentration on the flash on the flat surfaces is insignificant, and the cracks or damages of the piston 10 are unlikely to take place.

In the above-described embodiment, the mold matching surfaces between the molds are arranged such that the mold matching surfaces are located at positions different from the corners of the supporting areas 20 and 21 of the piston 10. It is possible to effectively prevent the occurrence of the flash at any of the corners of the piston 10 as the result of the casting. It is possible to safely prevent the supporting areas 20 and 21 of the piston 10 from being cracked or damaged due to excessively great stress.

Further, the stress concentration with respect to the piston 10 produced by carrying out the piston production method of the above-described embodiment is remarkably reduced, and the inherent strength of the piston 10 can be increased. The wall thickness of the supporting areas 20 and 21 of the piston 10 needed for obtaining the required strength against the external force can be reduced. Since the piston 10 can have a reduced wall thickness of the supporting areas 20 and 21, the weight of the piston 10 can be reduced. Therefore, because of the light weight of the piston 10, it is possible that the engine utilizing the piston 10 provide a reduced level of vibrations and piston noises when the engine is running. Further, because of the light weight of the piston 10, the inertial force when the piston 10 moves up and down can be reduced, and the piston production method of the above-described embodiment can provide the applicability to high rotational speed engines.

Further, conventionally, a repairing operation for the piston after the casting is finished is performed to remove the flash if the flash at any position of the piston is produced. In the above-described embodiment, the occurrence of the flash at the corners of the supporting areas 20 and 21 of the piston 10 is effectively prevent, and, therefore, the repairing operation is no longer needed and the cost for producing the piston 10 is reduced.

Figure 5:
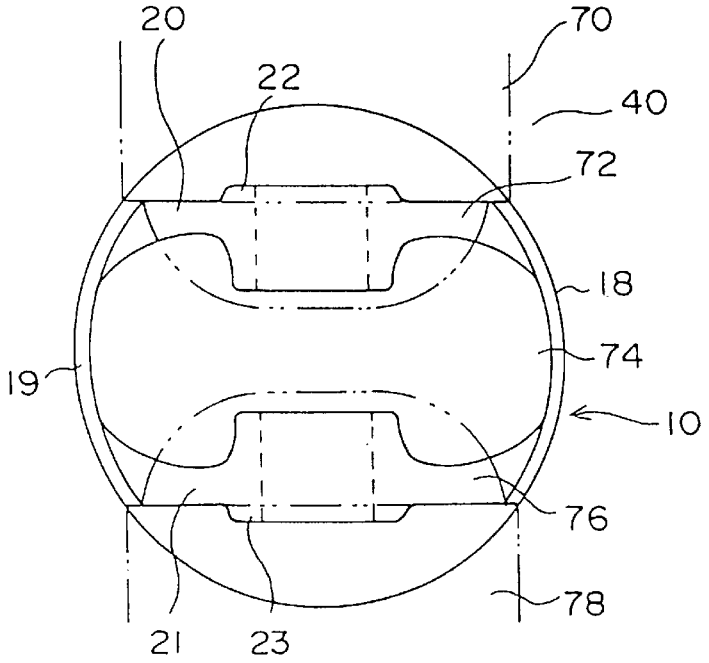
FIG. 5 is a bottom view of the piston of FIG. 1 with indications of mold matching surfaces used by a second embodiment of the piston production method.
Figure 6:
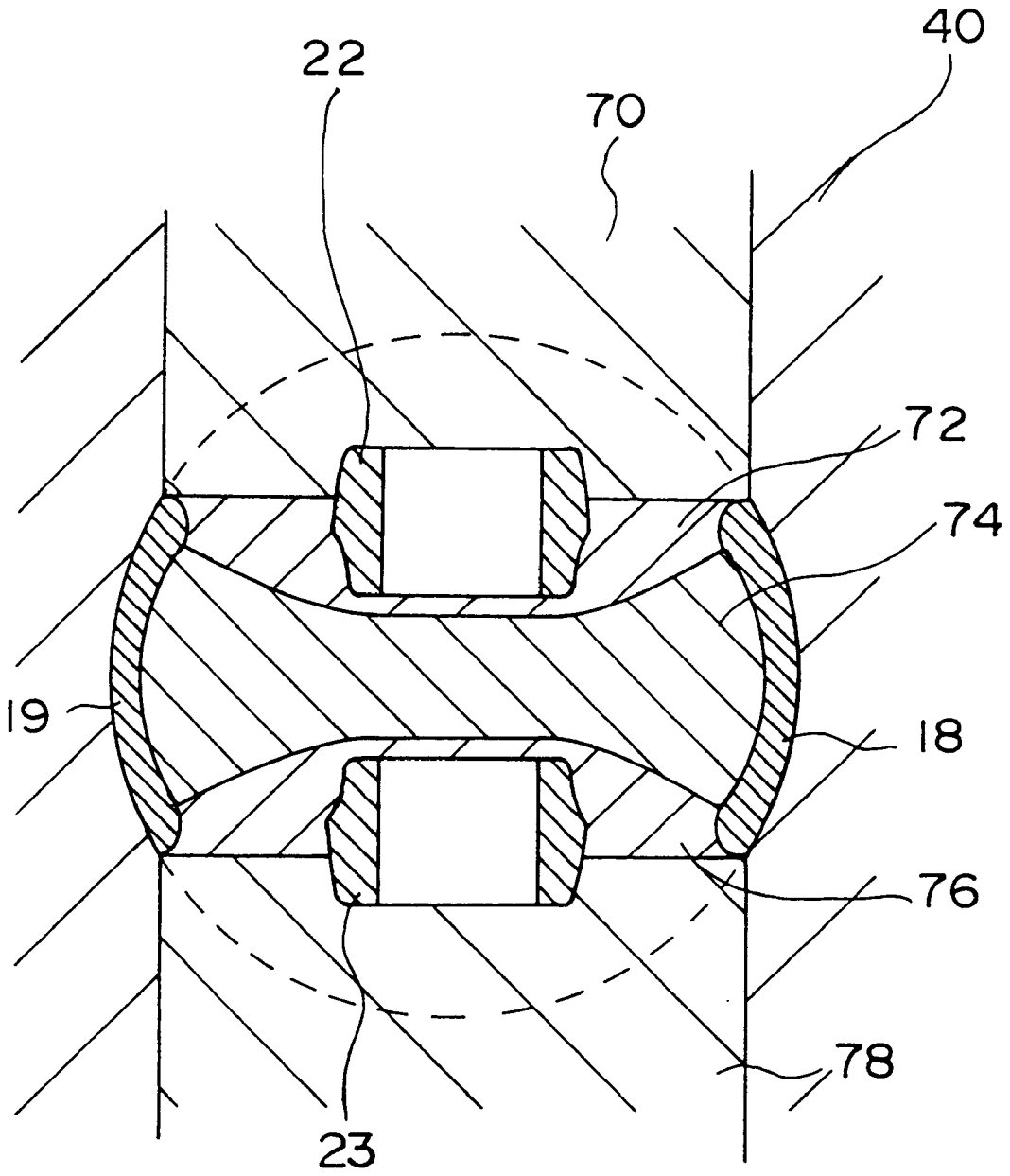
FIG. 6 is a cross-sectional view of the piston of FIG. 5 taken along the line III—III indicated in FIG. 1, with indications of molds used by the second embodiment of the piston production method.

FIG. 5 is a bottom view of the piston 10 of FIG. 1 with indications of mold matching surfaces used by a second embodiment of the piston production method. FIG. 6 is a cross-sectional view of the piston 10 of FIG. 5 taken along the line III—III indicated in FIG. 1, with indications of molds used by the second embodiment of the piston production method.

In FIGS. 5 and 6, the elements which are the same as corresponding elements in FIGS. 2 and 3 are designated by the same reference numerals, and a description thereof will be omitted.

As shown in FIGS. 5 and 6, when the casting for producing the piston 10 is carried out, the main mold 40 and a plurality of molds 70, 72, 74, 76 and 78 are used. Similarly to the first embodiment, the casting is performed to produce the piston 10 in its inverted condition wherein the piston 10 is inverted upside down (or the piston head 12 is placed on the bottom of the piston 10).

In the present embodiment, the molds 70 and 78 are external molds which are arranged outside the piston 10, the molds 72 and 76 are side core molds which are arranged inside the piston 10, and the mold 74 is a central core mold which is arranged inside the piston 10 and in the center of the cavities of the piston 10.

In the present embodiment, the outer surfaces of the pin bosses 22 and 23 and the supporting areas 20 and 21 of the piston 10 are shaped by the molds 70 and 78 which are arranged outside the piston 10. The inner surfaces of the pin bosses 22 and 23 and the supporting areas 20 and 21 are shaped by the core molds 72, 74 and 76 which are arranged inside the piston 10 and contacted by each other. More specifically, the inner surfaces of the pin boss 22 and the supporting area 20 are shaped by the side surface of the core mold 72, and the inner surfaces of the pin boss 23 and the supporting area 21 are shaped by the side surface of the core mold 76.

Further, the inner surfaces of the skirt areas 18 and 19 are shaped by the end surfaces of the mold 74. More specifically, the inner surface of the skirt area 18 is shaped by the right end surface of the mold 74, and the inner surface of the skirt area 19 is shaped by the left end surface of the mold 74.

Similarly to the first embodiment of FIG. 4, the bottom surface of the piston head 12 (in the inverted condition) is shaped by the lower surface of the main mold 40. The outer peripheral surfaces of the skirt area 18 and 19 and the piston head 12 are shaped by the inner side surfaces of the main mold 40. The piston pin bores 22*a* and 23*a* and the ring grooves 14, 16 and 17 are formed by subsequent machining after the casting is finished.

In the above-described second embodiment, a mold matching surface between the molds 70 and 72 and a mold matching surface between the molds 76 and 78 are arranged such that the mold matching surfaces do not accord with the corners of the supporting areas 20 and 21. That is, the mold 70 and the mold 72 are contacted by each other at positions different from the corners of the supporting area 20, and the mold 76 and the mold 78 are contacted by each other at positions different from the corners of the supporting area 21.

Similarly to the first embodiment of FIG. 4, in the above-described second embodiment, the corners 20*a* and 20*b* of the supporting area 20, the corners 21*a* and 21*b* of the supporting area 21, the corners 24*a* through 24*d* of the inner peripheral wall of the opening 24, and the corners 25*a* through 25*d* of the inner peripheral wall of the opening 25 are not located on the mold matching surfaces between the molds, and these corners are shaped by one of the molds 70, 72, 76 and 78. Each of the corners 20*a* and 20*b*, the corners 21*a* and 21*b*, the corners 24*a*–24*d* and the corners 25*a*–25*d* is formed by a rounded portion of a corresponding one of the molds 70, 72, 76 and 78 when the casting is performed.

Further, in the above-described second embodiment, as shown in FIGS. 5 and 6, a mold matching surface between the molds 74 and 72 is outwardly curved and directed to the peripheral edges of the skirt areas 18 and 19, and a mold matching surface between the molds 74 and 76 is outwardly curved and directed to the other peripheral edges of the skirt areas 18 and 19. External ends of these mold matching surfaces are located between the central portions of the skirt areas 18 and 19 and the peripheral edges of the skirt areas 18 and 19. That is, the external ends of the mold matching surfaces of the core molds 72, 74 and 76 are located at positions different from the central portions of the inside surfaces of the skirt areas 18 and 19. As described above, the inner surfaces of the skirt areas 18 and 19 are shaped by the end surfaces of the mold 74.

The casting for the production of the piston 10 in the above-described second embodiment is performed in a manner similar to the first embodiment.

As described above, the piston pin is fitted into the piston pin bores 22*a* and 23*a* of the piston 10, and the piston 10 is connected to the connecting rod by the piston pin. The connecting rod connects the crankshaft of the engine to the piston. When the crankshaft is rotated, the piston 10 moves up and down in the cylinder of the engine. At the time of the combustion stroke of the engine, the piston 10 transmits the power, obtained by the combustion of fuel in the combustion chamber, to the crankshaft through the connecting rod and the piston pin.

Therefore, during the reciprocating motion of the piston 10 within the cylinder of the engine, the skirt areas 18 and 19 are subjected to a frictional stress. A relatively great frictional stress on the skirt areas 18 and 19 is produced. In addition, when the crankshaft of the engine is rotated and the piston 10 moves up and down in the cylinder, a side force to press one of the skirt areas 18 and 19 against the cylinder is also produced. The stress concentration on the central portions of the skirt areas 18 and 19 is likely to take place.

Further, the piston head 12 forms the bottom of the combustion chamber of the engine, and heat energy from the combustion chamber is transmitted to the skirt areas 18 and 19 through the piston head 12. Therefore, the skirt areas 18 and 19 are subjected to a high temperature due to the heat energy from the combustion chamber. For this reason, it is more likely that the stress concentration on the skirt areas 18 and 19 takes place due to thermal stress on the skirt areas 18 and 19 produced by the heat energy from the combustion chamber. Especially, the central portions of the skirt areas 18 and 19 are subjected to a great stress due to the stress concentration.

Generally, when the casting for the production of the piston 10 is performed, molten metal may flow out of the clearance between two molds which are contacted by each other, and a flash on a mold matching surface between the two molds may be produced as the result of the casting. The flash has sharp edges, and the stress concentration on the flash of the casting is very likely to take place.

Therefore, if the central portions of the skirt areas 18 and 19 are located on the mold matching surfaces between the molds, the flash at the central portions of the skirt areas 18 and 19 of the piston 10 is likely to be produced as the result of the casting. If the flash at the central portions of the skirt areas 18 and 19 of the piston 10 is produced, the skirt areas 18 and 19 of the piston 10 may be cracked or damaged due to excessively great stress on the flash of the casting.

In the above-described second embodiment, the central portions of the skirt areas 18 and 19 are not located on the mold matching surfaces between the core molds 72, 74 and 76. The central portions of the inside surfaces of the skirt areas 18 and 19 are shaped by the core mold 74 only, and the central portions of the outside surfaces of the skirt areas 18 and 19 are shaped by the main mold 40 only. The central portions of the skirt areas 18 and 19 are formed by a corresponding one of the main mold 40 and the core mold 74 when the casting is performed. Therefore, in the above-described second embodiment, it is possible to effectively prevent the occurrence of the flash at the central portions of the skirt areas 18 and 19 when the casting is performed. It is possible to safely prevent the skirt areas 18 and 19 of the piston 10 from being cracked or damaged due to excessively great stress.

In the above-described second embodiment, the mold matching surfaces of the core molds 72, 74 and 76 are arranged such that the external ends of the mold matching surfaces of the core molds are located between the central portions of the skirt areas 18 and 19 and the peripheral edges of the skirt areas 18 and 19. It is possible to effectively prevent the occurrence of the flash at the central portions of the skirt areas 18 and 19 of the piston 10 as the result of the casting. It is possible to safely prevent the skirt areas 18 and 19 of the piston 10 from being cracked or damaged due to excessively great stress.

Further, the stress concentration with respect to the piston 10 produced by carrying out the piston production method of the second embodiment is remarkably reduced, and the inherent strength of the piston 10 can be increased. The wall thickness of the supporting areas 20 and 21 of the piston 10 needed for obtaining the required strength against the external force can be reduced. Since the piston 10 can have a reduced wall thickness of the supporting areas 20 and 21, the weight of the piston 10 can be reduced. Therefore, because of the light weight of the piston 10, it is possible for the engine utilizing the piston 10 that vibrations and piston noises when the engine is running be reduced. Further, because of the light weight of the piston 10, the inertial force when the piston 10 moves up and down can be reduced, and the piston production method of the above-described embodiment provides the applicability to high rotational speed engines.

Further, in the above-described second embodiment, the stress concentration at the skirt areas 18 and 19 is reduced and the maximum stress at the central portions of the skirt areas 18 and 19 is reduced. The deformation of the skirt areas 18 and 19 of the piston 10 which may be caused by repeated operation of the engine is remarkably reduced. Therefore, it is possible to maintain the clearance between the piston 10 and the cylinder at an appropriate level. In the above-described second embodiment, the burning of the skirt areas of the piston 10 during the operation of the engine can be prevented, and the piston noises when the engine is running can be reduced. In addition, the frictional resistance between the piston 10 and the cylinder can be reduced, and the engine utilizing the piston 10 produced according to the second embodiment can improve the fuel consumption.

Further, the repairing operation for the piston after the casting is finished is conventionally performed to remove the flash if the flash at any position of the piston is produced. In the above-described second embodiment, the occurrence of the flash at the central portions of the skirt areas 18 and 19 of the piston 10 is effectively prevent, and, therefore, the repairing operation is no longer needed and the cost for producing the piston 10 is reduced.

Similarly to the first embodiment, in the above-described second embodiment, it is necessary to prevent the occurrence the flash at any of the corners of the supporting areas 20 and 21 of the piston 10 as the result of the casting. Therefore, in the second embodiment, the mold matching surface between the molds 70 and 72 and the mold matching surface between the molds 76 and 78 are arranged such that the mold matching surfaces of these molds do not accord with the corners of the supporting areas 20 and 21. Advantages which are the same as the above-mentioned advantages of the first embodiment can be obtained when the piston production method of the second embodiment is carried out.

Further, the present invention is not limited to the above-described embodiments, and variations and modifications may be made without departing from the present invention.

What is claimed is:

1. A method of producing a piston through casting, wherein the piston has a piston head, a skirt, a pin boss and a supporting area, the supporting area connecting a periphery of the pin boss with the skirt, said method comprising the steps of:

arranging a plurality of molds such that the molds form cavities corresponding to a configuration of the piston;

arranging mold matching surfaces between the molds such that the molds are contacted by each other at positions different from corners of the supporting area of the piston; and performing a casting by using the molds so that the piston is produced.

2. The method according to claim 1, wherein the supporting area includes an opening at an intermediate portion between the skirt and the pin boss, and the molds are contacted by each other at positions different from corners of the opening.

3. The method according to claim 1, wherein the mold matching surfaces of the molds intersect flat surfaces of the supporting area.

4. The method according to claim 1, wherein an inside surface of the supporting area is shaped by one of the molds.

5. The method according to claim 1, wherein the casting is performed to produce the piston in an inverted condition in which the piston is inverted upside down and the piston head is placed on a bottom of the piston.

6. A method of producing a piston through casting, wherein the piston has a piston head, a pair of skirt areas, a pair of pin bosses and a pair of supporting areas, the supporting areas connecting peripheries of the pin bosses with the skirt areas, said method comprising the steps of:

arranging a main mold, a pair of external molds, a pair of side core molds and a central core mold such that said main mold, said external molds, said side core molds and said central core mold form cavities corresponding to a configuration of the piston;

arranging mold matching surfaces between the external molds and the side core molds such that the external molds and the side core molds are contacted at positions different from corners of the supporting areas of the piston;

arranging mold matching surfaces between the side core molds and the central core mold such that the side core molds are contacted by the central core mold, and external ends of the mold matching surfaces between the side core molds and the central core mold are located at positions different from central portions of the skirt areas; and performing the casting by using the main mold, the external molds, the side core molds and the central mold so that the piston is produced.

7. The method according to claim 6, wherein the external ends of the mold matching surfaces of the side core molds are located between the central portions of the skirt areas and peripheral edges of the skirt areas.

8. The method according to claim 6, wherein the casting is performed to produce the piston in an inverted condition in which the piston is inverted upside down and the piston head is placed on a bottom of the piston.

9. The method according to claim 6, wherein inside surfaces of the skirt areas are shaped by the central core mold which is a single mold.

10. The method according to claim 6, wherein inside surfaces of the supporting areas are shaped by the side core molds respectively.

* * * * *